US010287043B2

(12) United States Patent
Mackie et al.

(10) Patent No.: US 10,287,043 B2
(45) Date of Patent: May 14, 2019

(54) END CYCLE FILM CUTTER

(71) Applicant: 1137508 ON LTD., Scarborough (CA)

(72) Inventors: Laurie Robert Mackie, Oshawa (CA); Defu Lou, Ajax (CA)

(73) Assignee: 1137508 ON LTD., Scarborough (CA)

( * ) Notice: Subject to any disclaimer, the term of this patent is extended or adjusted under 35 U.S.C. 154(b) by 506 days.

(21) Appl. No.: 14/995,756

(22) Filed: Jan. 14, 2016

(65) Prior Publication Data

US 2017/0203870 A1 Jul. 20, 2017

(51) Int. Cl.

| | |
|---|---|
| ***B65B 41/12*** | (2006.01) |
| ***B65B 11/04*** | (2006.01) |
| ***B65B 61/06*** | (2006.01) |
| ***B26F 1/08*** | (2006.01) |
| ***B26F 1/24*** | (2006.01) |

(52) U.S. Cl.

CPC ..... *B65B 41/12* (2013.01); *B26F 1/08* (2013.01); *B26F 1/24* (2013.01); *B65B 11/045* (2013.01); *B65B 61/065* (2013.01)

(58) Field of Classification Search

None

See application file for complete search history.

(56) References Cited

U.S. PATENT DOCUMENTS 2,636,654 A * 4/1953 Thomas ..... B65B 25/14 100/7
3,250,053 A * 5/1966 Hyer ..... B65B 41/16 53/389.3
4,204,377 A * 5/1980 Lancaster ..... B65B 11/006 53/399
5,572,850 A * 11/1996 Lancaster, III ..... B65B 11/045 53/389.3
5,765,344 A * 6/1998 Mandeville ..... B65B 11/025 53/389.3
2004/0055252 A1* 3/2004 Suolahti ..... B65B 11/025 53/399
2006/0130432 A1* 6/2006 Predieri ..... B65B 11/00 53/441
2006/0272286 A1* 12/2006 Chiu Chen ..... B65B 51/06 53/136.3
2007/0204564 A1* 9/2007 Lancaster, III ..... B65B 11/006 53/399
2008/0066431 A1* 3/2008 Cousins ..... B65B 11/045 53/465
2015/0151861 A1* 6/2015 Chalmers ..... B65D 19/00 53/556

* cited by examiner

*Primary Examiner* — Hemant Desai
*Assistant Examiner* — Chinyere J Rushing-Tucker
(74) *Attorney, Agent, or Firm* — Norton Rose Fulbright Canada LLP

(57) ABSTRACT

Apparatuses and methods are provided in relation to a wrapping machine for wrapping packages, and more particularly, to a film-breaking apparatus for use with a wrapping machine having a dispenser carriage movable along a wrapping axis for wrapping a film around a package. The film-breaking apparatus includes a trigger arm coupled to the dispenser carriage; a puncturing arm including a puncturing member, the puncturing arm pivotably connected to the trigger arm such that the trigger arm is free to rotate relative to the puncturing arm in a first rotational direction, and rotationally coupled to the puncturing arm in a second rotational direction. The puncturing arm is configured to puncture the film being dispensed by the dispenser carriage with the puncturing member when rotated by the trigger arm.

18 Claims, 17 Drawing Sheets

END CYCLE FILM CUTTER

FIELD

This disclosure relates to a wrapping machine for wrapping packages, and more particularly, to a film-breaking apparatus for use with a wrapping machine.

BACKGROUND

Packages are often wrapped with film to bind the package in various contexts, such as to prepare the package for transport. Pallets supporting the packages may also be wrapped, in some situations, so that the package can be more readily loaded or lifted by a machine, such as a fork lift.

The wrapping of packages may require various steps, one of which may be the breaking of the film at the end of the wrapping process. The breaking of the film is often performed manually, with varying levels of effectiveness.

An apparatus for breaking the film may be desirable.

SUMMARY

In accordance with an aspect, there is provided a film-breaking apparatus for a wrapping machine having a dispenser carriage movable along a wrapping axis for wrapping a film around a package, the film-breaking apparatus comprising: a trigger arm coupled to the dispenser carriage; a puncturing arm including a puncturing member, the puncturing arm pivotably connected to the trigger arm such that the trigger arm is free to rotate relative to the puncturing arm in a first rotational direction, and rotationally coupled to the puncturing arm in a second rotational direction; the trigger arm configured to contact a striking member of the wrapping machine and rotate in the first rotational direction during motion of the carriage in a first direction along the wrapping axis, and to contact the striking member of the wrapping machine to cause rotation of the puncturing arm in the second rotational direction during motion of the carriage in a second direction along the wrapping axis, thereby puncturing the film being dispensed by the dispenser carriage with the puncturing member.

In an aspect, the wrapping machine includes one or more guide members configured to guide movement of the dispenser carriage along the wrapping axis.

In an aspect, the film is a sheet of film that is stretched for wrapping around the package.

In an aspect, the striking member is a flange.

In an aspect, the film-breaking apparatus operates mechanically, free of electrical components.

In an aspect, the movement of the dispenser carriage combined with the rotation of either the package or the wrapping machine causes the package to be wrapped in a helical manner.

In an aspect, the film is a polyethylene stretch film.

In an aspect, the film-breaking apparatus further comprises a biasing spring for biasing the puncturing arm such that the puncturing arm returns to an inactive position after rotation of the puncturing arm in the second rotational direction.

In an aspect, the wrapping machine further comprises a turntable to rotate the package.

In an aspect, the wrapping machine is configured to rotate the film dispenser in relation to the package.

In accordance with an aspect, there is provided a method of wrapping a film around a package, the method comprising: attaching a film dispensed from a dispenser carriage to the package; wrapping the film around the package, thereby drawing the film from the dispenser carriage; moving the dispenser carriage along a wrapping axis, such that one or more layers of film are disposed onto the package generally in a spiral pattern, the one or more layers of film together binding the package; engaging a striking member of the wrapping machine by movement of the dispenser carriage along the wrapping axis, thereby triggering rotation of a puncturing arm of the dispenser carriage to puncture the film; breaking the punctured film by application of tension.

In an aspect, wrapping the film around the package includes at least rotating the package such that rotation of the package draws the film from the dispenser carriage.

In an aspect, the dispenser carriage is mounted to an arm; wrapping the film around the package includes at least rotating the arm such that rotation of the arm draws the film from the dispenser carriage.

In an aspect, the method further comprises passing the dispenser carriage past the striking member a first time without rotating puncturing arm.

In an aspect, passing striker member first time comprises rotating a trigger arm in a first direction and engaging the striking member comprises rotating the trigger arm in a second direction.

In an aspect, the method further comprises returning puncturing arm to an inactive position with a biasing spring.

In an aspect, the engaging of the striking member comprises rotating a trigger arm.

In an aspect, the method further comprises preloading the film in the dispensing carriage.

In an aspect, engaging the striking member to puncture the film includes puncturing the preloaded film.

A wrapping machine having a dispenser carriage movable along a wrapping axis for wrapping a film around a package, the dispenser carriage having a film-breaking apparatus, the film-breaking apparatus comprising: a trigger arm coupled to the dispenser carriage; a puncturing arm including a puncturing member, the puncturing arm pivotably connected to the trigger arm such that the trigger arm is free to rotate relative to the puncturing arm in a first rotational direction, and rotationally coupled to the puncturing arm in a second rotational direction; the trigger arm configured to contact a striking member of the wrapping machine and rotate in the first rotational direction during motion of the carriage in a first direction along the wrapping axis, and to contact the striking member of the wrapping machine to cause rotation of the puncturing arm in the second rotational direction during motion of the carriage in a second direction along the wrapping axis, thereby puncturing the film being dispensed by the dispenser carriage with the puncturing member.

Many further features and combinations thereof concerning embodiments described herein will appear to those skilled in the art following a reading of the instant disclosure.

DETAILED DESCRIPTION

Figure 1A:
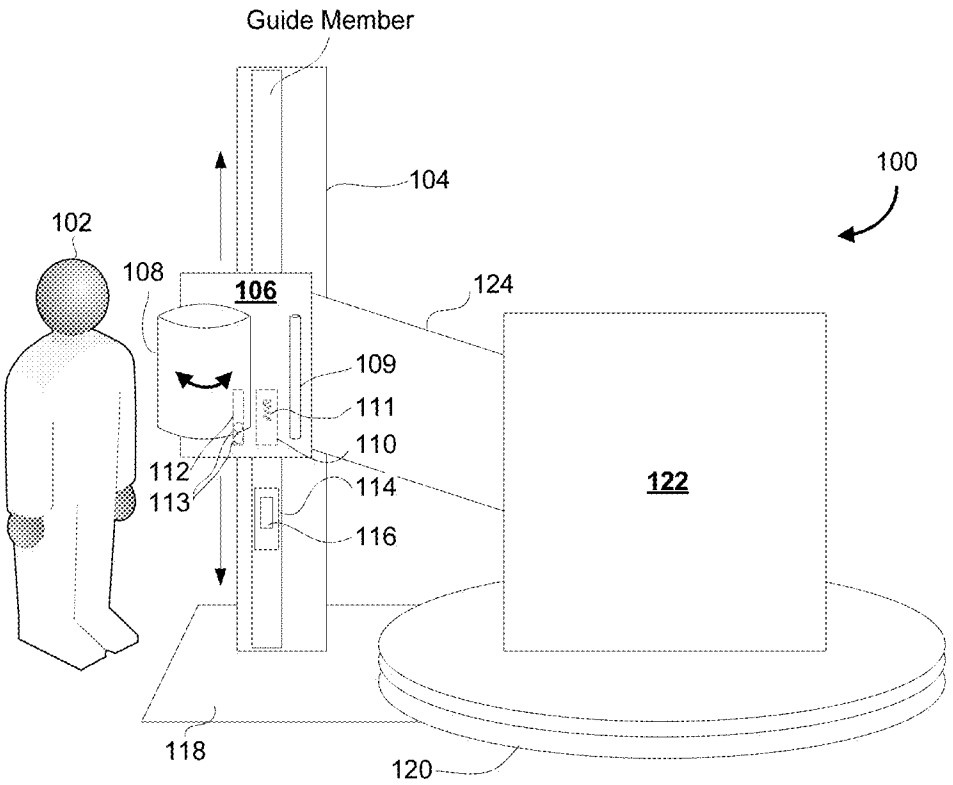
FIG. 1A is a perspective view of a wrapping machine, according to some embodiments.

Referring to FIG. 1A, an example wrapping machine 100 having a film-breaking apparatus is illustrated, in accordance with some embodiments. In some embodiments, the operation of the wrapping machine 100 may be manual, semi-automated, or fully automated (e.g., having one or more electro-mechanical mechanisms that guides the operation of the wrapping machine 100.

The wrapping machine 100 may be utilized in a variety of different contexts or applications, and may, for example, be utilized in the preparation of packages 112 such that the packages 112 are tightly bound with layers of film. The wrapping machine 100 may be useful in industrial contexts, wherein packages 112 may be loads of goods stacked or otherwise disposed on pallets, and the wrapping of the packages 112 may be performed prior to transportation, or movement of the packages 112. Goods may be provided in the form of boxes, containers, etc. The goods may also include loose objects. Wrapping may prevent or limit shifting of objects during movement of a pallet. In some embodiments, the pallets themselves may be wrapped along with a package 122, so that the package 122 stays on the pallet during transportation and the pallet may aid in the transportation of the package 122. Various types of films, such as polyethylene stretch films, may be used, and these films may have of various types of gauges, dimensions, or physical properties. For example, the films may have different properties on different sides (e.g., a front, stickier face for adherence to a package 122, and a back, more durable face, for resistance to the elements during transportation).

For example, the gauges, dimensions, or physical properties may have an impact on how the film-breaking apparatus operates as some films may be more easily punctured, require different types of puncturing, may operate under differing levels of tension, etc. The ease of tearing of the film after puncturing may also vary depending on the gauges, dimensions, or physical properties of the film, and position/characteristics of the punctures. In some embodiments, the film may be more readily torn if more tension is provided, for example, through the clamping of the film or the prevention of dispensing of further film by a film dispenser.

As a specific example, the wrapping machine 100 may be utilized in relation to military transportation, where materiel or other types of goods may need to be securely packaged together for transportation to strategic or tactical locations. Such goods may require packaging for transportation via terrestrial vehicles, airplane, seafaring vessel, shipping containers, etc., and may need to packaged such that the packages 122 are able to withstand various types of environmental conditions, loading/unloading, and external stresses. For example, the packages 122 may need to be air-dropped into various operational theatres, or air-lifted from locations.

Typically, wrapping a package using a wrapping machine may be labour-intensive. Depending on the type and configuration of wrapping machine, the wrapping machines may require the use of a skilled operator 102. In conventional wrapping machines, one step performed by the operator 102 may include the breaking of the film towards the end of the wrapping process. The operator 102 may, for example, utilize a knife or other object to break the film. However, such a step may impose delays in industrial workflows, cause repetitive stress injuries to the operator 102, or result in safety issues in view of the operator 102 utilizing a knife in an industrial setting where machines or other workers may be present. Accordingly, a film-breaking apparatus may be desirable for use with wrapping machine 100 that is able to break the film at the end of the wrapping process. Elimination or reduction of a step in the process may lead to faster, more economical or safer industrial packaging.

As shown in FIG. 1A, the wrapping machine 100 may include various structural components, which may include, for example, a tower 104; a dispenser carriage 106; a film roll 108; a pre-stretch mechanism 109, a film breaking apparatus having a trigger arm 110, spring 111, and a puncturing arm 112; and a striker plate 114 having a striking member 116; a base 118; and a rotary mechanism 120. The wrapping machine 100 may be adapted to support a package 122 atop rotary mechanism 120 and to cause the wrapping of the package 122 with film dispensed from the film roll 108 by rotation of the package 122.

As depicted in FIG. 1A, the film breaking apparatus is configured to cause the puncturing of the film 124 before the film is passed through the pre-stretch mechanism 109. The puncturing of the film 124 before the film is passed through the pre-stretch mechanism 109 may aid in the tearing of the film 124 after puncturing. For example, a pre-stretch mechanism 109 may include two rollers through which film 124 is passed through. The second roller may operate at a speed (e.g., three times) faster than the first roller, causing a stretch of the film prior to placement on package 122. When the film 124 is punctured, the punctures may be advantageously elongated as the film 124 passes through the pre-stretch mechanism 109, causing the film 124 to be more readily torn after it has passed through pre-stretch mechanism 109.

In other embodiments, the film breaking apparatus is configured to cause the puncturing of the film 124 after the film is passed through the pre-stretch mechanism 109. Such a configuration may be advantageous as film 124 may be more readily punctured after it has been stretched by the pre-stretch mechanism 109. For example, the puncturing members 113 may be less likely to slip or encounter greater resistance when puncturing the film 124.

The wrapping machine 100 may be provided having a variety of different configurations, and the structural components provided are examples and there may be more, less, alternate, or different components to the wrapping machine 100. The wrapping machine 100 may operate wherein various components have different orientations, dimensions or configurations, and FIG. 1A is provided merely as an example. For example, the film roll 108 may be provided in differing positions in relation to dispenser carriage 106. The film roll 108 may be on the front, or the back of dispenser carriage 106, and may be configured to rotate in various directions in feeding film 124 (e.g., film may be fed in a forward direction from the film roll 108, or in a backwards direction from the film roll 108). The direction of feed from film roll 108 may impact the configuration and positioning of puncturing arm 112 and trigger arm 110.

The wrapping machine 100 may be utilized in a variety of different contexts or applications, and may, for example, be utilized in the preparation of packages 122 such that the packages 112 are tightly bound with layers of film. The tower 104 may be disposed in an upright or substantially upright position, and may include features which permit the motion of the dispenser carriage 106 along an axis. The features that permit motion may include, for example, guides, protrusions, rails, cavities, etc. For example, dispenser carriage 106 may be slide-ably mounted to tower 104 with a set of rails. One or more actuator mechanisms (not shown) may be provided to move carriage 106 up and down along tower 104. For example, carriage 106 may be movable up and down along tower 104 using a belt or chain drive mechanism or other suitable drive mechanism. In some embodiments, the tower 104 may also include one or more control mechanisms that may be utilized to receive signals representative of instruction sets to control the one or more actuator mechanisms accordingly. In some embodiments, the tower 104 may be configured for manual operation, wherein an operator 102 may manually raise or lower the dispenser carriage 106 along the axis.

Rotary mechanism 120 is disposed proximate tower 104 for dispensing of film from carriage 106 onto a package 122 supported on rotary mechanism 120. Rotary mechanism 120 used to rotate the package 122 as the package 122 is being wrapped with the film by the wrapping machine 100. For example, the film may be stretched over a portion (e.g., a corner) of the package 122, and as the package 122 rotates, adhering or adhesive features of the film may cause it to remain attached to the package 122 (e.g., clinging to, stuck to), and thus causing the extension of the film over part or the entirety of the package 122.

The dispenser carriage 106 is adapted for supporting a film dispensing tool, such as a film roll 108, and undergoing translational motion along the axis through the course of wrapping a package 122. The dispenser carriage 106 may be a stand-alone unit for placement onto or use with a tower 104 or other wrapping machine 100. The dispenser carriage 106 may also include one or more pre-stretch rollers, such may be adapted to engage the film from the film roll 108 to maintain a level of tension or stretch, depending on the desired characteristics of the film for use with wrapping the package 122.

Figure 1B:
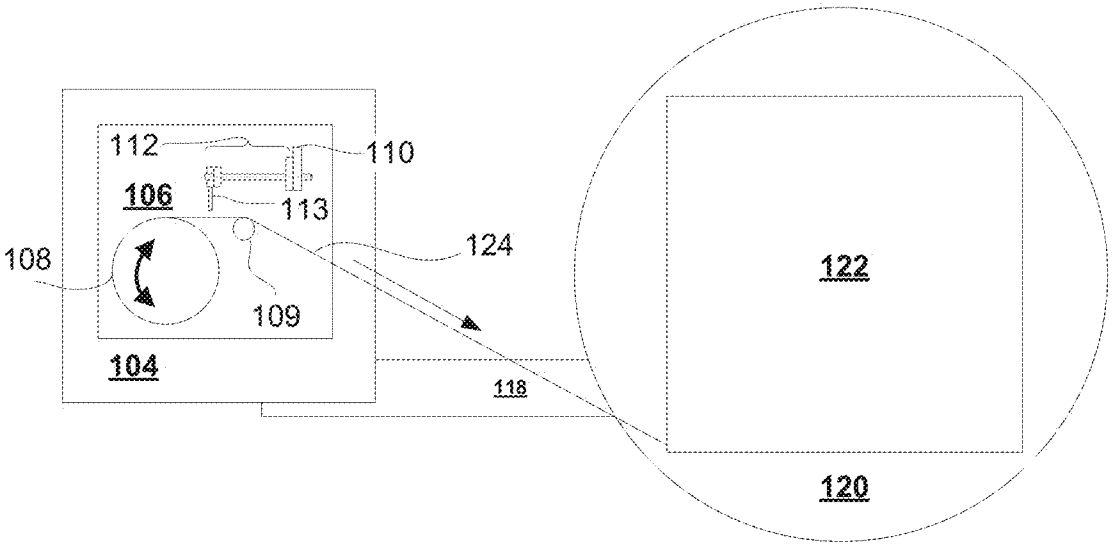
FIG. 1B is a top view of a wrapping machine, according to some embodiments.
Figure 1C:
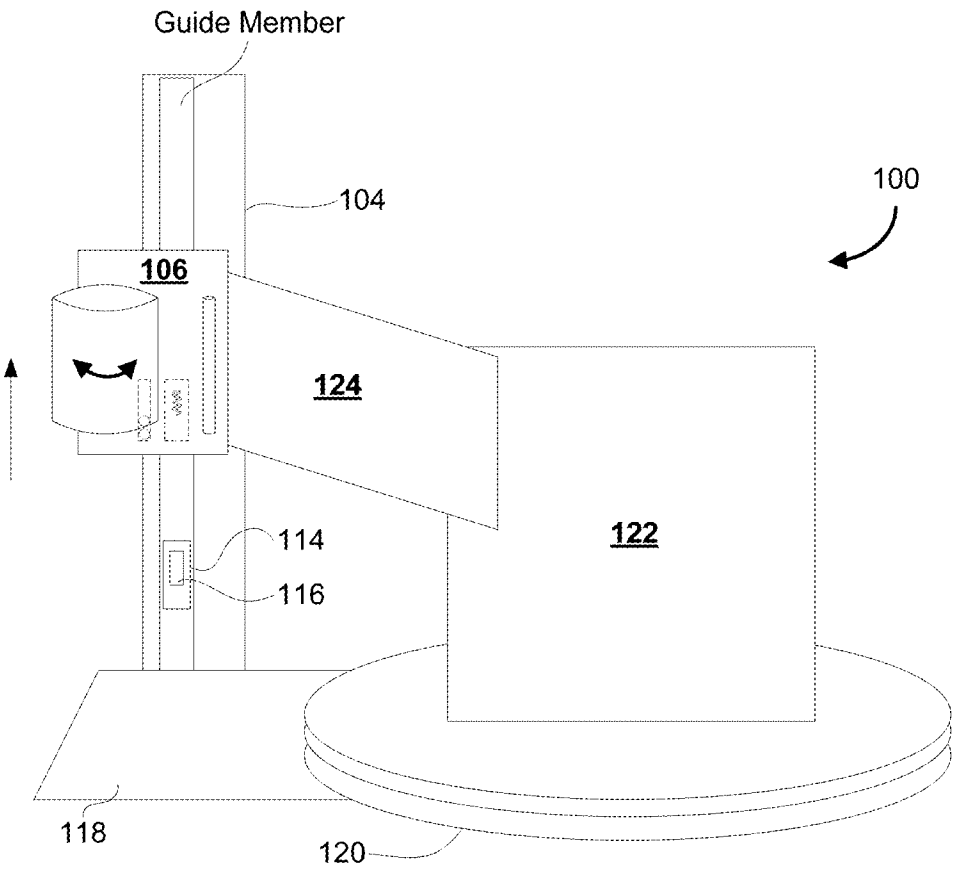
FIG. 1C is a perspective view of a wrapping machine where a dispenser carriage is moving upwards, according to some embodiments.
Figure 1D:
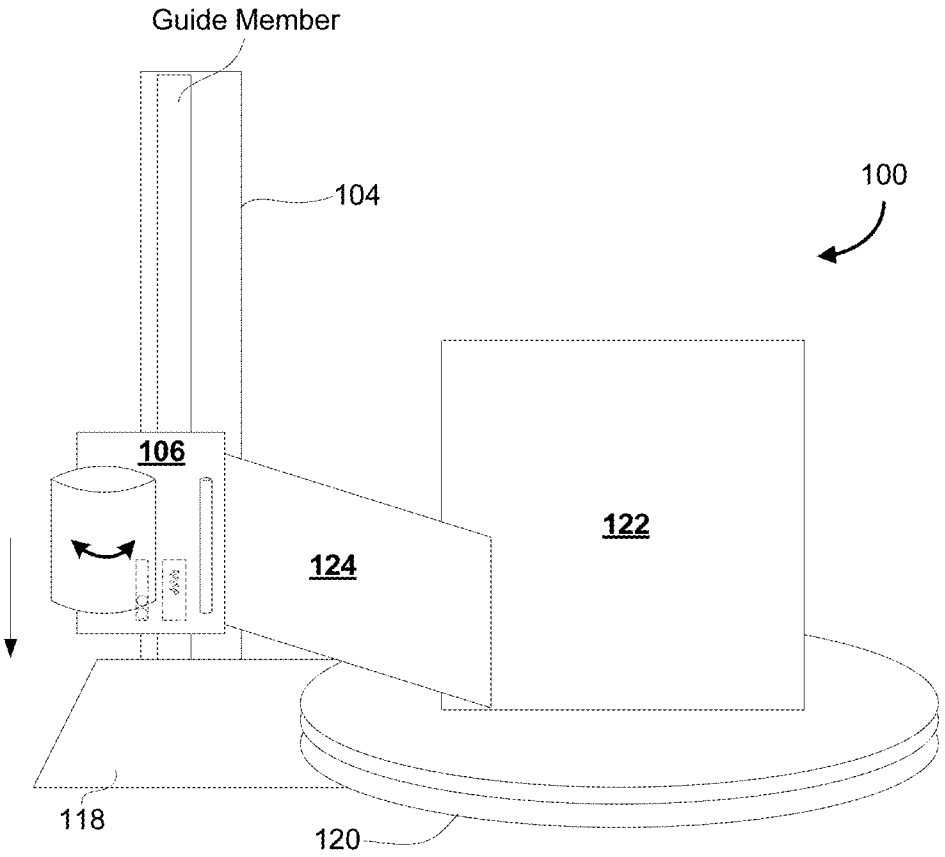
FIG. 1D is a perspective view of a wrapping machine where a dispenser carriage is moving downwards, according to some embodiments.
Figure 1E:
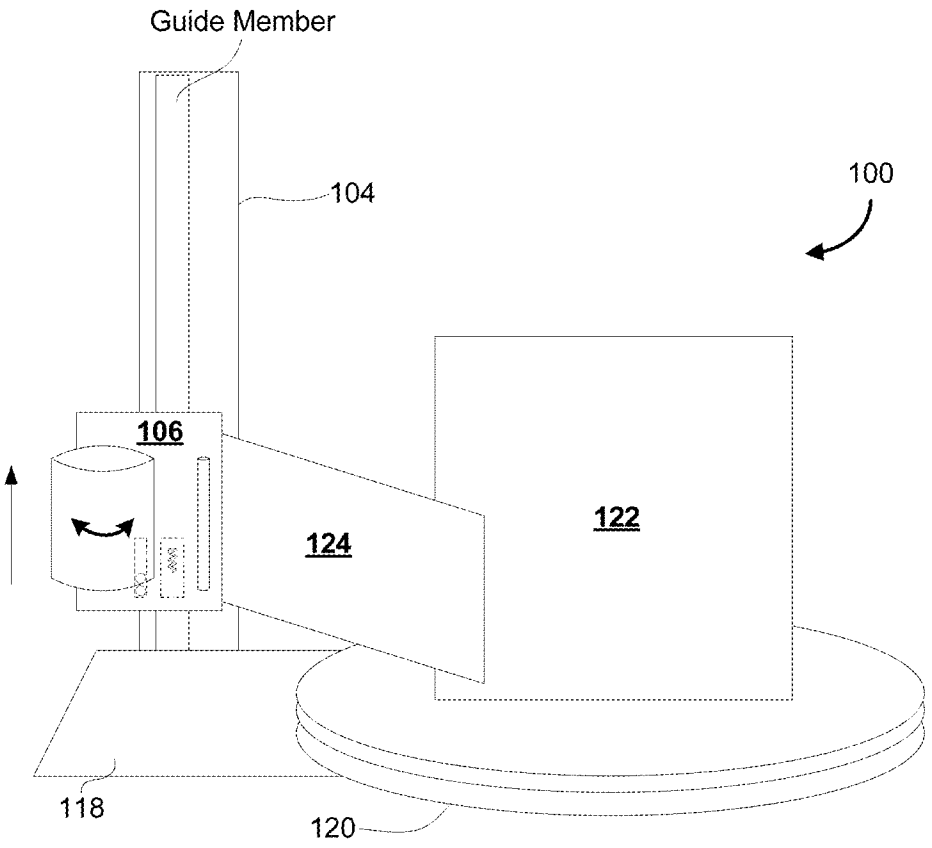
FIG. 1E is a perspective view of a wrapping machine where a dispenser carriage is moving upwards nearing the end of wrapping a package, according to some embodiments.

FIG. 1B is a top view of the wrapping machine, according to some embodiments. As depicted in FIG. 1B, the wrapping machine is configured to dispense a film from the film roll 108 onto package 122. The film may be pre-stretched by the pre-stretch mechanism 109, and dispensed along the straight arrow on to the package 122. Wrapping the package 122 may involve moving the dispenser carriage 106 along a wrapping axis (e.g., up/down) to wrap the full height of the package, as shown in FIGS. 1C-1E and described in further detail below. As depicted, the wrapping axis is vertical, such that the carriage moves upwardly in a first direction along the wrapping axis, and downwardly in a second direction along the wrapping axis, but in other embodiments, the wrapping axis may be oriented differently.

The dispenser carriage 106 may include a film breaking apparatus, which is adapted for breaking the film at a particular stage in the wrapping of the package 122. The film breaking apparatus may have an arm including a trigger arm 110 and a puncturing arm 112 having one or more puncturing members 113. The dispenser carriage 106 is adapted such that the dispenser carriage 106 is able to dispense film during the wrapping process, and towards the end of the wrapping process, the dispenser carriage 106, through the film breaking apparatus, automatically triggers the breaking of the film. Some elements may be shown in phantom as in some embodiments, the elements are positioned on the side of the dispenser carriage 106 adjacent to tower 104.

Figure 2:
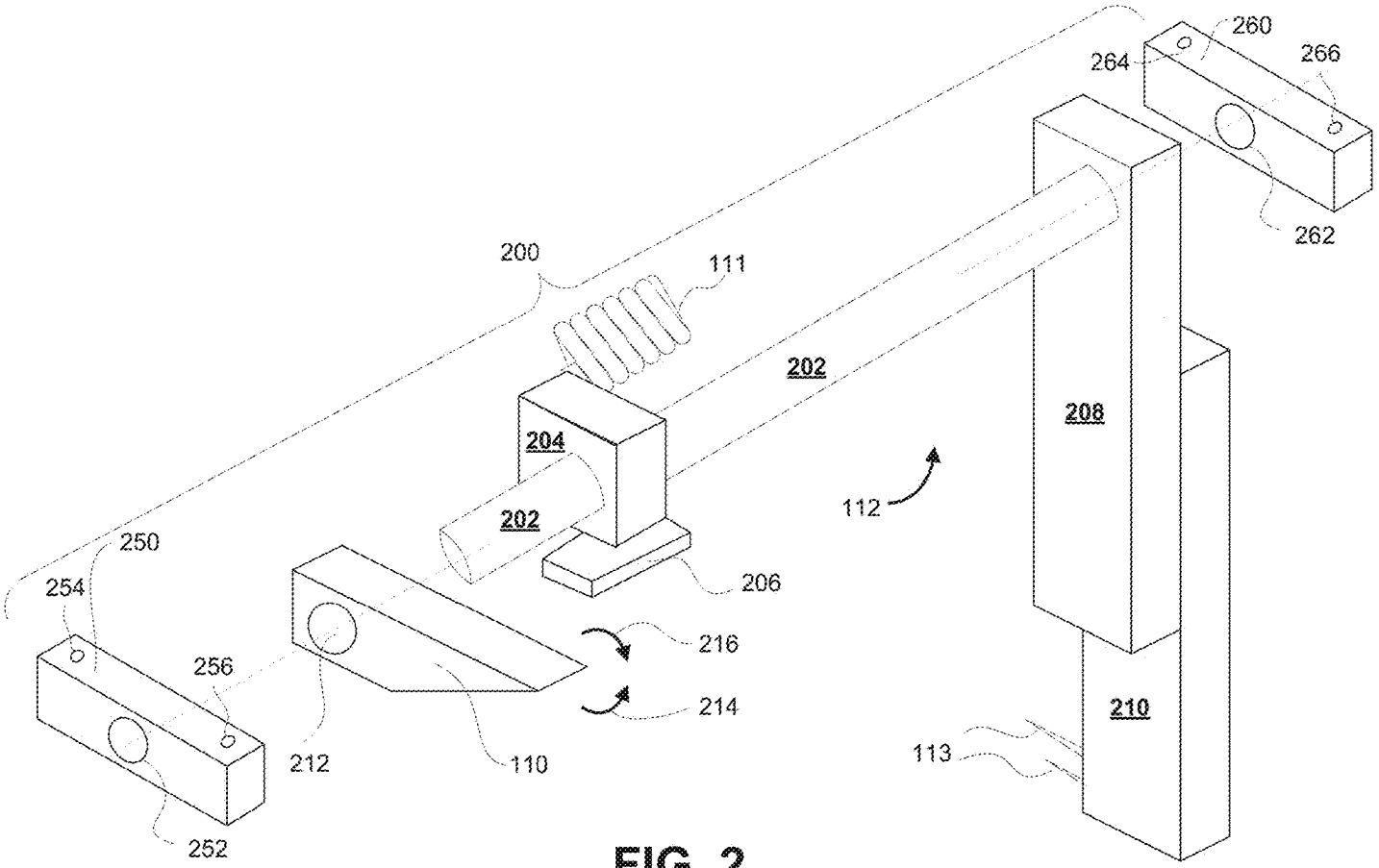
FIG. 2 is a partial exploded view of a film breaking apparatus, according to some embodiments.

The trigger arm 110 and the puncturing arm 112 are pivotably connected to one another such that said trigger arm 110 is free to rotate relative to said puncturing arm 112 in a first direction, indicated by arrow 214 in FIG. 2, and rotationally coupled to said puncturing arm 112 in a second direction, indicated by arrow 216 in FIG. 2. The reference directions along the wrapping axis, such as the first direction, and second direction, that the dispenser carriage 106 is movable in are depicted in FIG. 1A.

The tower 104 has a striker plate 114 having a striking member 116 disposed thereon. The striker plate 114 or the striking member 116 may be configured such that the striker plate 114 or the striking member 116 remains in a substantially stationary or fixed position during the wrapping of the package 122. The striking member 116 may, for example, be a flange, a protrusion, or a lip, and may be attached to the tower 104 by means of the striker plate 114. The trigger arm 110 of the film-breaking apparatus is configured to contact the striking member 116 of the wrapping machine 100 and rotate in the first direction during motion of the dispenser carriage 106 downwards along said wrapping axis.

The trigger arm 110 may be configured to contact the striking member 116 of the wrapping machine 100 and rotate in a second direction during motion of the dispenser carriage 106 in a second direction along said wrapping axis. For example, the second direction may be an upwards position. As the dispenser carriage 106 travels upwards, the trigger arm 110 may be adapted such that the trigger arm 110 or a part thereof contacts the striking member 116 of the wrapping machine 100 and rotates in the second direction during motion of the carriage in a second direction along the wrapping axis.

The puncturing arm 112 may be coupled (e.g., mechanically or structurally coupled, integral to, adhering to, fastened to, forming one piece with) with trigger arm 110 such that when the trigger arm 110 rotates in the second direction, the puncturing arm 112 likewise rotates or otherwise moves, causing the puncturing members 113 situated on or otherwise disposed relative to the puncturing arm 112 to contact and pierce film 124 being dispensed by the film roll 108 on to the package 122. After puncturing, the film 124 may be broken as a result of the tension forces experienced by the compromised film 124. In some embodiments, the film 124 is selected such that the film is able to detach or rip after it is punctured. The puncturing members 113 may be configured in various ways to puncture the film 124 in particular locations, dimensions, etc. In other embodiments, the rotation of film roll 108 may be stopped to provide further tension or pre-stretch mechanism 109 may be utilized to clamp the film 124 to provide further tension.

Accordingly, the wrapping machine 100 may, wrap the package 122 with the film and also cause the cutting of the film to end wrapping of a package and conveniently be set up for use for wrapping another package 122.

FIG. 2 is a partially-exploded perspective view of the film breaking apparatus, according to some embodiments. The film breaking apparatus comprises an arm having two portions, a trigger arm 110 and a puncturing arm 112. The puncturing arm 112, as depicted, includes a rod 202 which may be fixed or otherwise attached to members 204, 208, and 210. Member 204 has a lip 206 and is attached to the dispenser carriage 106 by way of spring 111. Member 208 and member 210 are fixedly attached (e.g., welded) to the rod 202, and member 210 has puncturing members extending from it. Mounting blocks 250 and 260 are shown. These mounting blocks 250 and 260 are configured to receive rod 202 through cavities 252 and 262. The mounting blocks 250 and 260 are fixedly attached to attachment points in the dispenser carriage 106 (e.g., through attachment pins 254, 256, 264, 266), and may be adapted such that rod 202 may rotate freely within the cavities 252 and 262.

The puncturing arm 112 is shown having two puncturing members, namely pins 113 located proximate a distal end of the puncturing arm 112. In other embodiments, other types of puncturing members may be provided instead of or in addition to pins 113. For example, the puncturing members may include blades, barbs, or other implements suitable for introducing a break or cut in the wrapping film. These pins 113 may be adapted to rotate in a direction such that the pins 113 strike the film 124 being dispensed by the dispenser carriage 106 at an angle that may be substantially perpendicular to the plane of film being extended from the dispenser carriage 106. On striking the film 124, the puncturing members puncture the film, creating rips or holes in the film 124.

As depicted, the trigger arm 110 and the puncturing arm 112 may be commonly mounted to a rod 202. Rod 202 may be fixed to or integrally formed with the puncturing arm 112. Trigger arm 110 has a cavity 212 for receiving rod 202 such that the trigger arm 110 is able to rotate relative to the rod 202. As shown in FIG. 2, the rod 202 of the puncturing arm 112 is welded on to a flange 206 of the puncturing arm, such that flange 206 is pressed upon when the trigger arm 110 rotates in one direction 216, but is not pressed upon when the trigger arm 110 rotates in the opposite direction 214. Thus, contact between trigger arm 110 and flange 206 rotationally couple trigger arm 110 and puncturing arm 112 in one direction. In other embodiments, the trigger arm 110 and the puncturing arm 112 may be coupled together in other ways, for example using mechanical coupling features such as bearings, ball-and-socket joints, gears, magnets, elastics, in different configurations. Thus, when rotated in direction 216 by contact with the striking member 116, trigger arm 110 may likewise cause rotation of the puncturing arm 112. Conversely, when rotated in direction 214, trigger arm 110 may pivot freely about rod 202 without causing rotation of puncturing arm 112.

As noted, the puncturing arm 112 may have one or more puncturing members, e.g. pins 113. The puncturing members 113 are adapted for causing holes or rips in the film (e.g., a stretched film). The puncturing members 113 may be pins, protrusions, etc., and may be shaped or sharpened such that the puncturing members 113 are more readily able to puncture the film. The puncturing members 113 may be of the same or differing dimensions (e.g., lengths), and may be positioned at various points along the puncturing arm 112. The positioning or repositioning of the puncturing members 113 may aid in the puncturing of film where there may be advantages to puncturing the film at positions disposed at various distances apart from one another. For example, due to the physical characteristics of the film, there may be advantages in puncturing the film at three different locations equidistant from one another, near the top and the bottom of the film, two locations having a specific distance from one another, etc. In some embodiments, the puncturing arm 112 is adapted with a variety of receptacles for puncturing members 113 such that the puncturing members may be dynamically repositioned at different positions, or more or less puncturing members 113 may be provided for use.

In a variant embodiment, trigger arm 110 and puncturing arm 112 may be configured to rotate together in both directions 214 and 216. For example, trigger arm 110 and puncturing arm 112 may be rotationally attached to one another such that when trigger arm 110 engages the striking member 116 as the dispenser carriage 106 is moving in an downwards direction on the wrapping axis, both the trigger arm 110 and the puncturing arm 112 rotate. Puncturing members 113 rotate in a direction upon which they do not puncture film 124. When the dispenser carriage 106 is moving in an upwards direction on the wrapping axis and the striking member 116 is engaged, the trigger arm 110 and puncturing arm 112 may rotate together in direction 216, causing the puncturing members 113 to rotate in a direction in which film 124 is punctured.

Figure 3C:
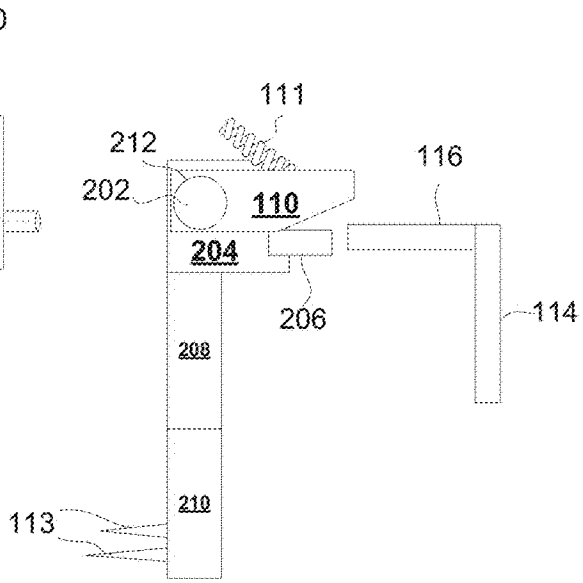
FIG. 3C is a side elevational view of the film breaking apparatus, according to some embodiments.
Figure 3B:
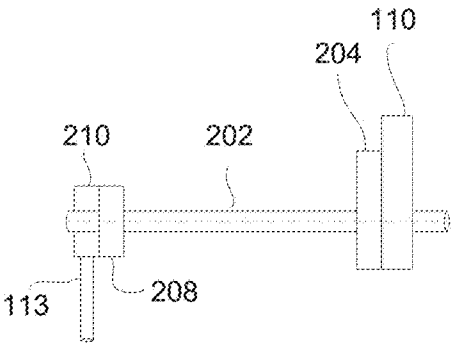
FIG. 3B is a top elevational view of the film breaking apparatus, according to some embodiments.
Figure 3A:
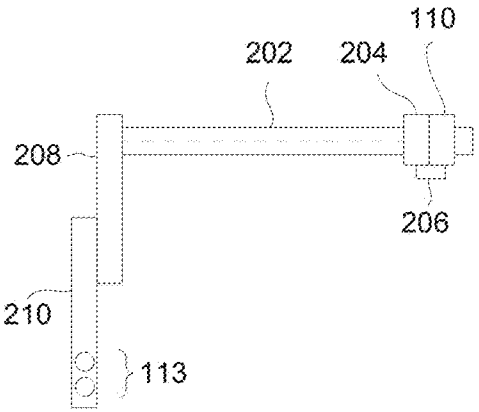
FIG. 3A is a front elevational view of the film breaking apparatus, according to some embodiments.

FIGS. 3A, 3B and 3C are front, top and side elevational views of the film breaking apparatus, according to some embodiments, where the trigger arm 110 is positioned on the rod 202 of the puncturing arm 112.

FIG. 3C also depicts striker plate 114 and striker member 116. The film breaking apparatus is mounted to the dispenser carriage 106. The trigger arm 110 of the film breaking apparatus is designed to rotate relative to a pivot point. As depicted in FIG. 3C, the film breaking apparatus is adapted such that the trigger arm 110 is able to freely rotate without triggering the puncturing arm 112 when the trigger arm 110 passes the striking member 116 from movement of dispenser carriage 106 in one direction along the wrapping axis, and to rotate and impart a rotational on the puncturing member when the trigger arm 110 passes the striking member 116 from movement of dispenser carriage 106 in another direction along the axis.

The trigger arm 110 may have a top face that may be substantially flat, and a lower face that may be tapered. The striking member 116 is attached to the striker plate 114, which itself is mounted on to the tower 104. The striking member 116 remains fixed during the movement of the dispenser carriage 106.

In operation, a package 122 is first provided on to the rotary mechanism 120. The dispenser carriage 106 may be loaded with a film roll 108 in a slot configured to permit the rotation of the film roll 108 in dispensing film.

A film may be extended from the film roll 108 over a portion or a corner of the package 122, such that when the package 122 rotates, the film 124 is dispensed through tension on the film 124 and the rotation of the film roll 108. As the film 124 is not likely wide enough to cover the height of package 122 in its entirety, one or more layers of film are required to be deposited on the package 122 such that, for example, the one or more layers of film together secure (e.g., bind) the package 122. The one or more layers of film may be overlapping, or not overlapping with one another. For example, in some embodiments, the one or more layers of film may be overlapping to impart a level of water or fluid resistance to the wrapped package 122. The extension of the film 124 over a portion or a corner of the package 122 may be initially performed so that the package 122 is prepared for the wrapping process.

During the wrapping process, the rotary mechanism 120 rotates the package 122, and while the rotary mechanism 120 is rotating the package 122, the dispenser carriage 106 is undergoes translational motion along the axis provided by the tower 104. The translational motion may be, for example, in an upwards or a downwards direction. Thus, film may be dispensed onto the package 122 in a number of rotational passes as the dispenser carriage 106 along the height of the package 122. The simultaneous rotation of the package 122 and movement of the dispenser carriage 106 causes the film to be disposed as layers of film on the package 122, for example, causing the helical or spiral disposition of film on the package 122. Adjacent passes of film 124 may overlap one another.

In some embodiments, the dispenser carriage 106 starts substantially near the bottom of a package 122, and travels upwards to near to top of the package 122, and back downwards near the bottom of the package 122 such that the package 122, in its entirety, is covered with layers of film.

In some embodiments, the dispenser carriage 106 may start at other positions (e.g., an arbitrary height) and the wrapping process may involve the movement of the dispenser carriage 106 to various heights (e.g., not limited to just a first up and then a second down motion). For example, an operator 102 may wish to deposit multiple layers of film on a package 122 at a particular height where a part of the package 122 may be particularly susceptible to damage during transportation, etc.

As the wrapping process is nearing an end, the dispenser carriage 106 may be moved to a position that may be near or substantially near the striker plate 114 or striking member 116 positioned on the tower 104.

As depicted at FIGS. 1C-1E, the dispenser carriage 106 may be raised (see FIG. 1C) gradually as film 124 is dispensed on the package 122 in an upwards helical fashion.

The dispenser carriage 106 may then be lowered (see FIG. 1D) gradually to continue wrapping the package 122 until it reaches the bottom of package 122. During the downwards motion, the trigger arm 110 passes by the striking member 116 but does not trigger the puncturing member 112. The dispenser carriage 106 may then be raised again (see FIG. 1E) whereby the trigger arm 110 contacts the striking member 116, causing puncturing member 112 to rotate in direction 216, puncturing film 124 with pins 113.

FIGS. 4A-4F, and 4H-4I are views provided to illustrate the operation of the film breaking apparatus as the film breaking apparatus is being utilized to break the film 124, according to some embodiments.

The film breaking apparatus may be engaged such that on a first pass of the striking member 116, the film breaking apparatus is not activated (e.g., the trigger arm 110 may freely rotate relative to the puncturing arm 112 to allow the trigger to freely pass the position of the striking member 116 when travelling past the striking member 116 in a first direction). On a second pass of the striking member 116 in a second direction, the trigger arm 110 may contact the striking member 116, causing the trigger arm 110 to bear against flange 206 such that the trigger arm 110 rotates along with the puncturing arm 112. The rotation of the puncturing arm 112 causes the puncturing members 113 to extend and puncture the film.

Figure 4A:
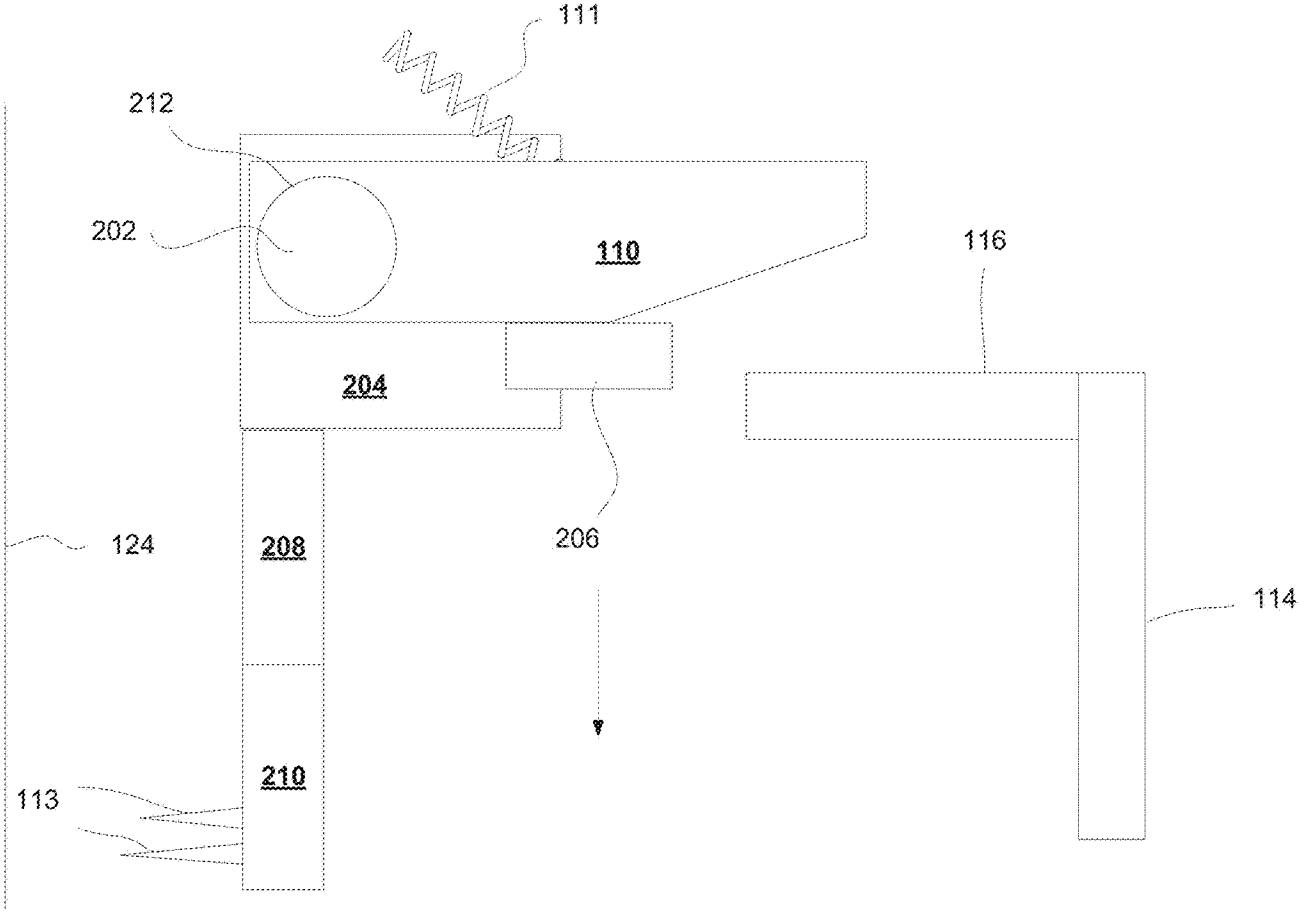
FIG. 4A-4E are side elevational views of the film breaking apparatus in various stages of operation, according to some embodiments.

FIG. 4A is illustrative of the trigger arm 110 of the film breaking apparatus with carriage 106 moving downwardly before passing the striking member 116. Trigger portion 110 approaches the striking member 116 through the movement of the dispenser carriage 106. At this stage, the wrapping of the package 122 is nearly complete and the dispenser carriage 106 is moved to a position nearing the bottom of the package 122 such that the bottom of the package 122 or the pallet can be wrapped with film.

Figure 4B:
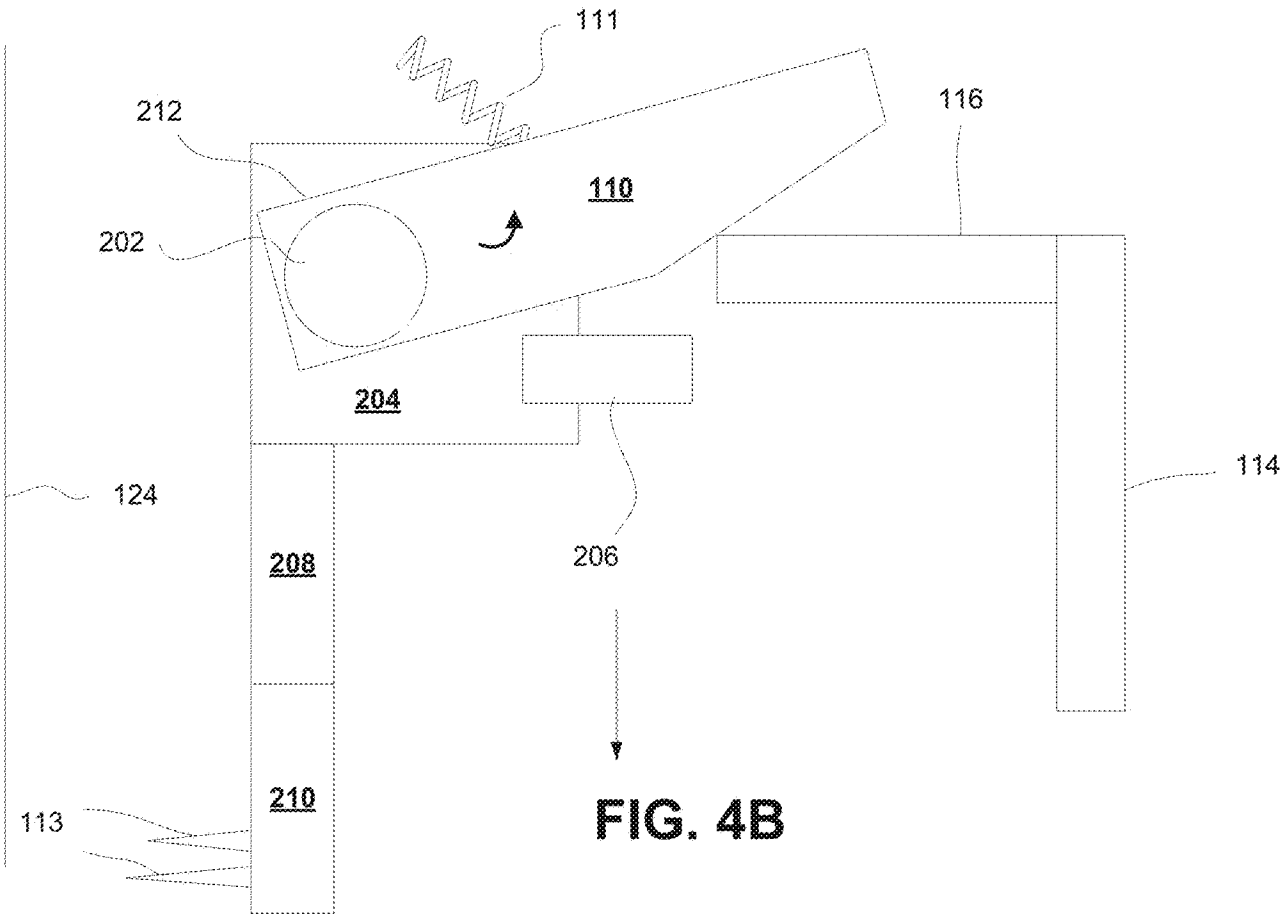
Figure 4C:
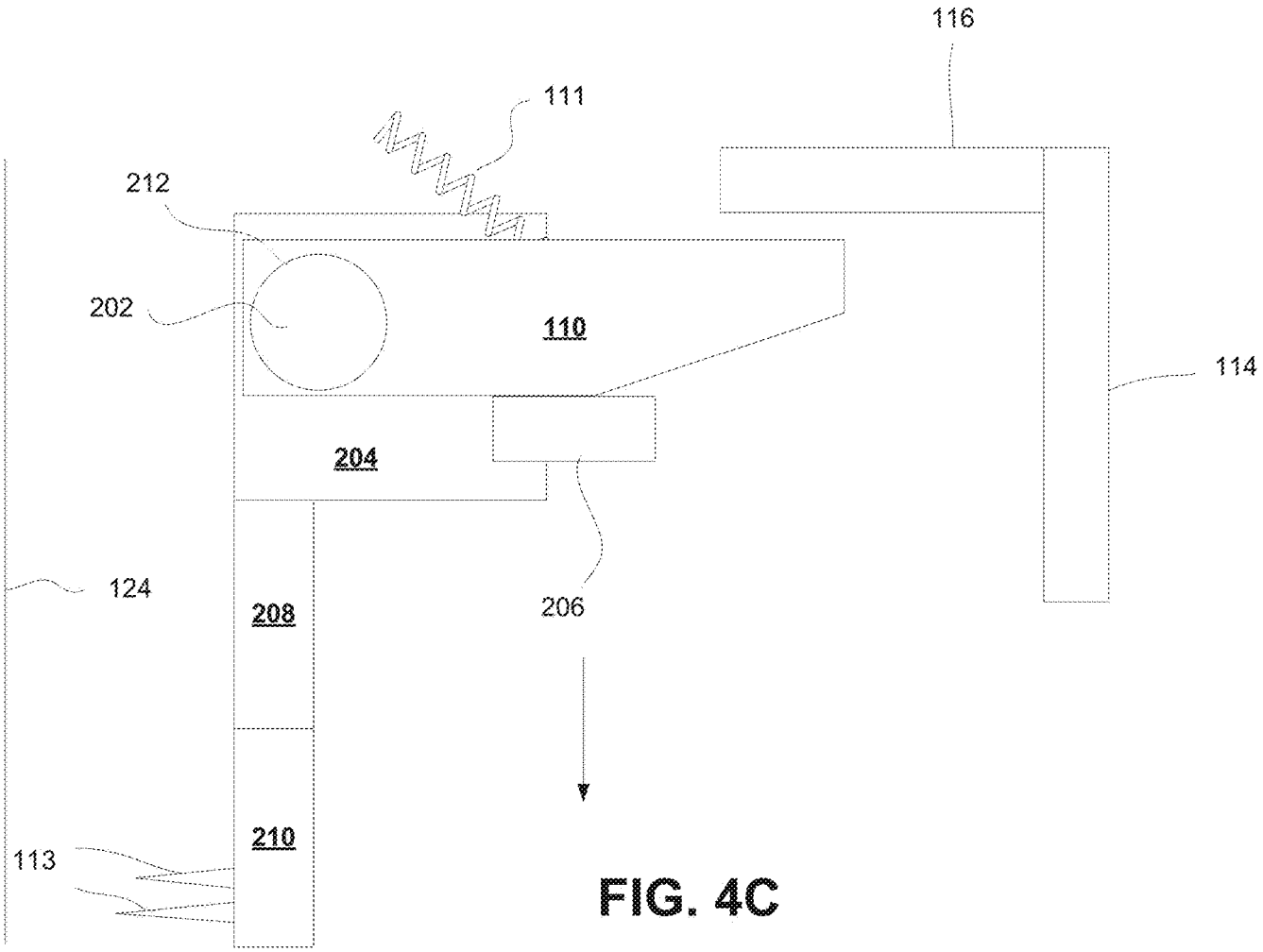

As the dispenser carriage 106 moves past the striking member 116 towards the end of the wrapping process, the trigger arm 110 contacts striking member 116 and rotates around rod 202 in direction 214. During such rotation, trigger arm 110 does not engage puncturing arm 112. FIG. 4B is illustrative of the trigger arm 110 of the film breaking apparatus during the first pass of the striking member 116, according to some embodiments. As depicted, the trigger arm 110 rotates freely in the counterclockwise direction, and the puncturing arm 112 is not engaged. After the dispenser carriage 106 moves past the striking member 116 in the first direction, the trigger arm 110 returns to its initial position (e.g., through gravity), as shown in FIG. 4C.

Figure 4D:
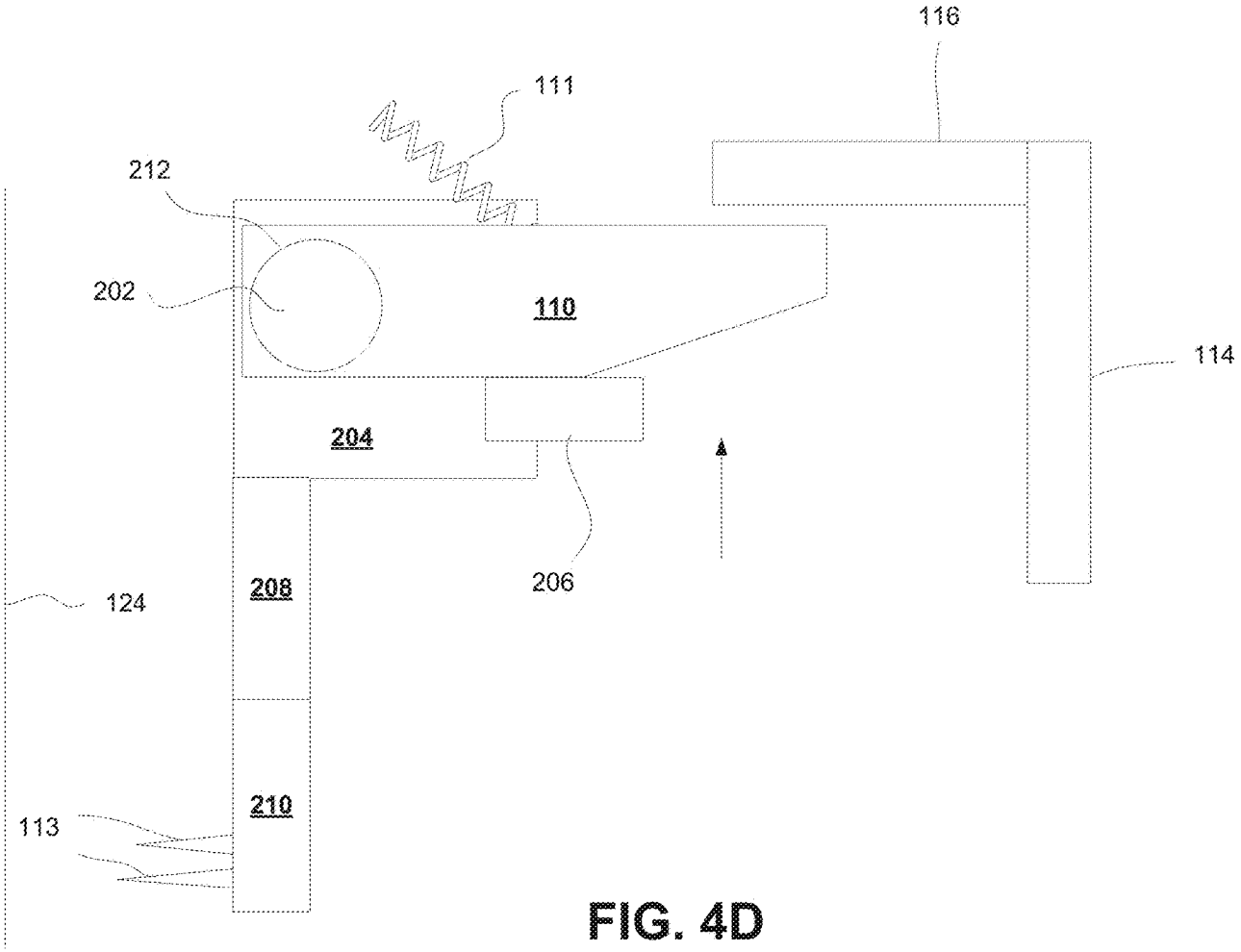

Following the wrapping of the bottom of the package 122 or the pallet with film, the dispenser carriage 106 is then moved in a direction such that the trigger arm 110 will re-engage the striking member 116, albeit from a different direction. As depicted in FIG. 4D, carriage 106 is moved upwardly so that the top surface of trigger arm 110 approaches striker member 116. FIG. 4D shows the trigger arm prior to engagement of the striking member 116 as it is moving upwardly.

Figure 4E:
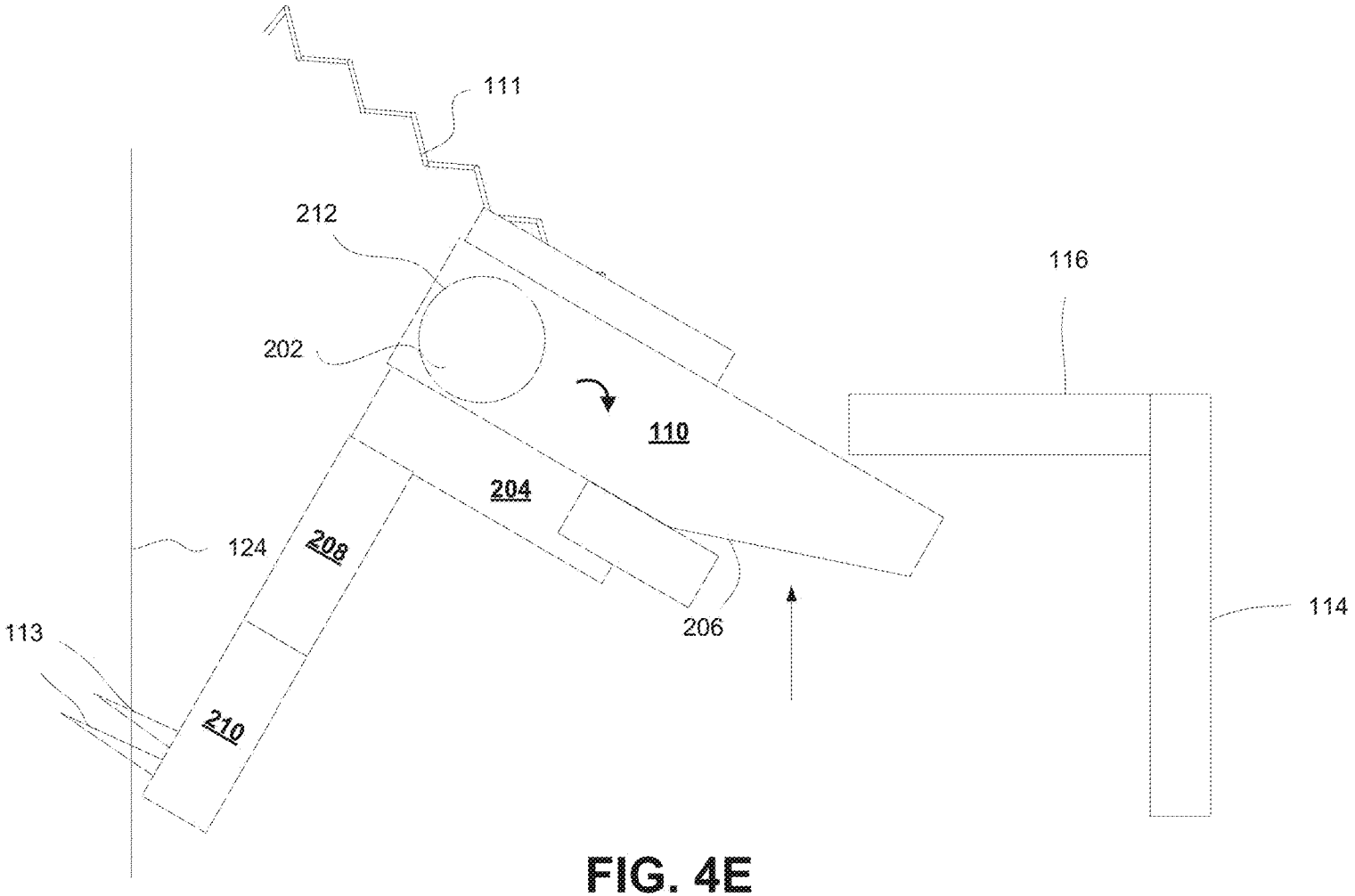

FIG. 4E shows the trigger arm 110 engaging the striking member 116 from the second direction. When the top of trigger arm 110 contacts striking member 116 from this direction, the striking member 116 may impact or otherwise impart a force on to the puncturing arm 112. As shown in FIG. 4E, the trigger arm 110 rotates in the clockwise direction. As it rotates, trigger arm 110 bears against flange 206, thus causing the puncturing arm 112 to rotate.

Figure 4F:
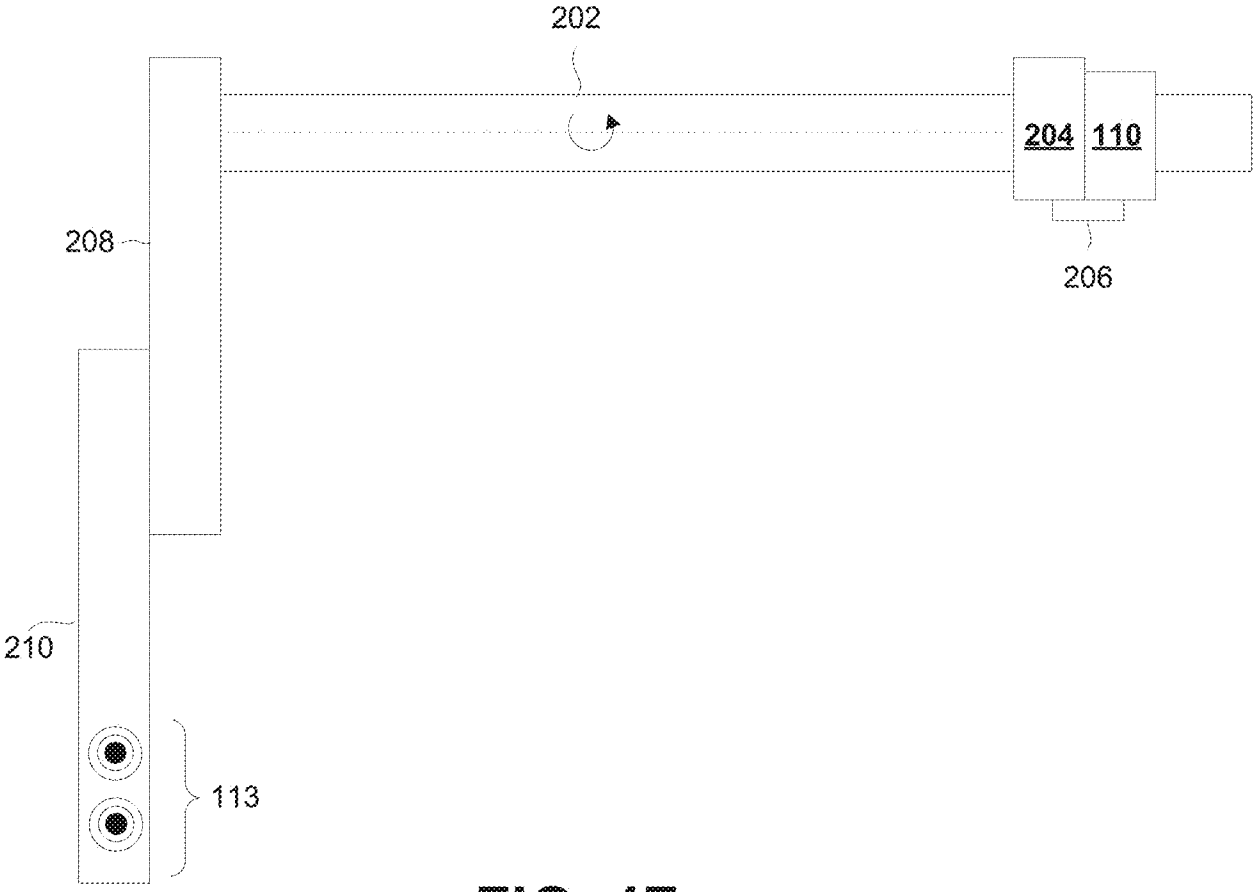
FIG. 4F is a front elevational view of the film breaking apparatus, according to some embodiments.
Figure 4G:
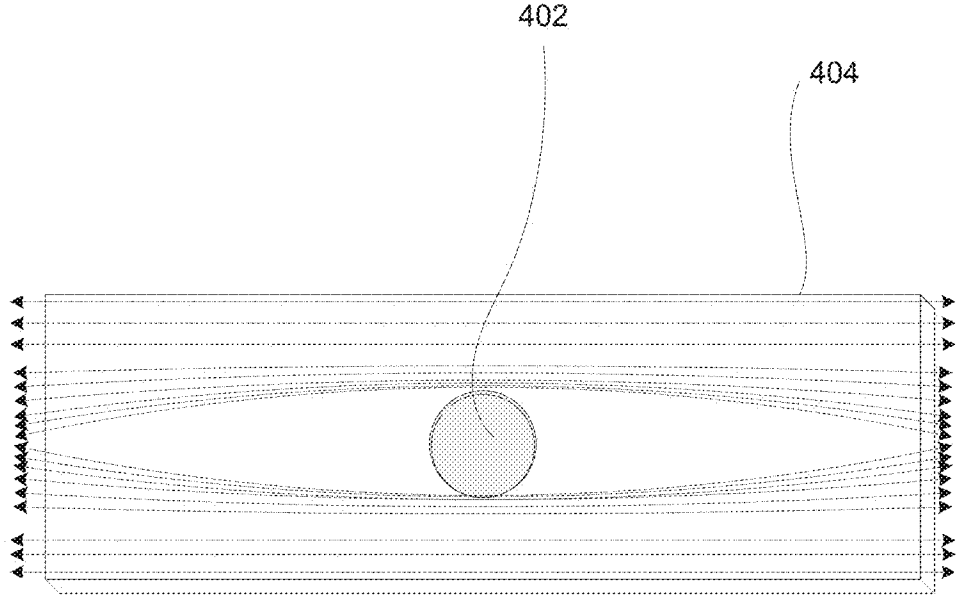
FIG. 4G is an example diagram illustrative of tension forces resulting from a puncture, according to some embodiments.

As shown in FIG. 4F, the rotation of the puncturing arm 112 causes the puncturing members 113 to rotate in the same or another direction and contact the film, thus causing the puncturing the film at one or more puncturing positions. The puncturing members 113 are illustrated with circles with dots to indicate that the puncturing members 113 rotate in a direction that is "coming out" of the plane of FIG. 4F. The direction of movement of the puncturing members 113 is provided merely as an example, and is not meant to be limiting. For example, the puncturing members 113 may be moved in any direction that causes the puncturing members 113 to strike and therefore puncture the film. FIG. 4G is a depiction of stresses that may be experienced by the stretched sheet of film having one or more punctures, according to some embodiments.

The puncturing members 113 may, for example, cause one or more holes or rips to be formed in the film. These one or more holes or rips may provide stress risers or portions of concentrated stress to form in the film, and the film may have physical properties wherein as a result of the one or more holes or rips in the film, cause the film to tear (e.g., fully rip, become cut), detaching the film that is being disposed on the package 122 from the film roll 108. As a result, the package 122 may be wrapped and the wrapping machine 100 may have a trailing segment of film left (e.g., hanging) from the wrapping machine 100, which may then be utilized to begin the wrapping of another package 122.

The pins 113 may contact the film at various locations in the film 124. For example, contact may be made at one or more points (e.g., by a number of pins 113), the punctures may be in the middle of the film 124, towards the top or the bottom of the film 124, equally spaced apart, etc.

In some embodiments, the detachment of the film may also be aided through the use of stretching mechanisms 109, which may stretch the film before or after puncturing. For example, rotation of the film roll 108 may be stopped while package 122 continues to rotate. This may cause stretching of the film such that the film experiences a greater level of tension after the one or more holes or rips in the film have been formed. As the package 122 continues to rotate, an increasing level of tension is experienced by the film. The film 124 may rip, e.g., by propagation of a tear beginning along or substantially near where the one or more holes or rips in the film have been formed.

In some embodiments, the stretching mechanism may be a separate mechanism utilized to stop or otherwise impede the rotation of the film roll 108. Such an mechanism may include, for example, a brake (e.g., a disk brake, a drum break), a stopper arm, a clamp, etc. In some embodiments, the pre-stretch mechanism 109 may perform the function by increasing a clamping force such that the pre-stretch mechanism 109 substantially impedes the dispensing of film from the dispensing carriage.

Figure 4H:
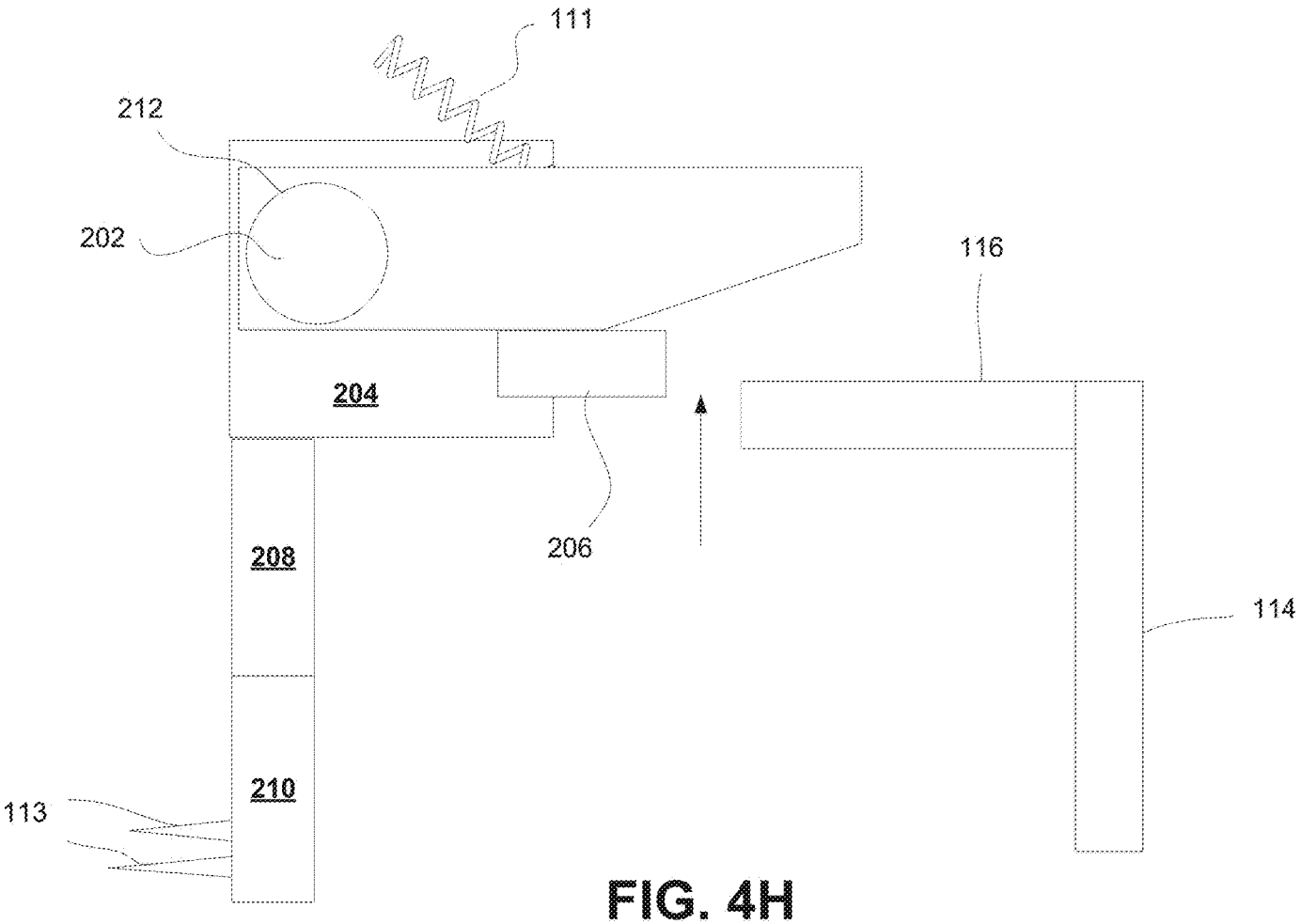
FIG. 4H is a side elevational view of the film breaking apparatus in various stages of operation, according to some embodiments.

FIG. 4H shows the film breaking apparatus after passing by the striking member 116, according to some embodiments. As shown in FIG. 4H, the biasing mechanism on the film breaking apparatus causes the trigger arm 110 to reset in a neutral position. The biasing mechanism, for example, may be a spring that is attached to the film carriage and the trigger arm 110, such that when the trigger arm 110 rotates in one or more directions, the trigger arm 110 is returned to a neutral position, through for example, application of a tension force by the stretching or compression of the spring.

Figure 4I:
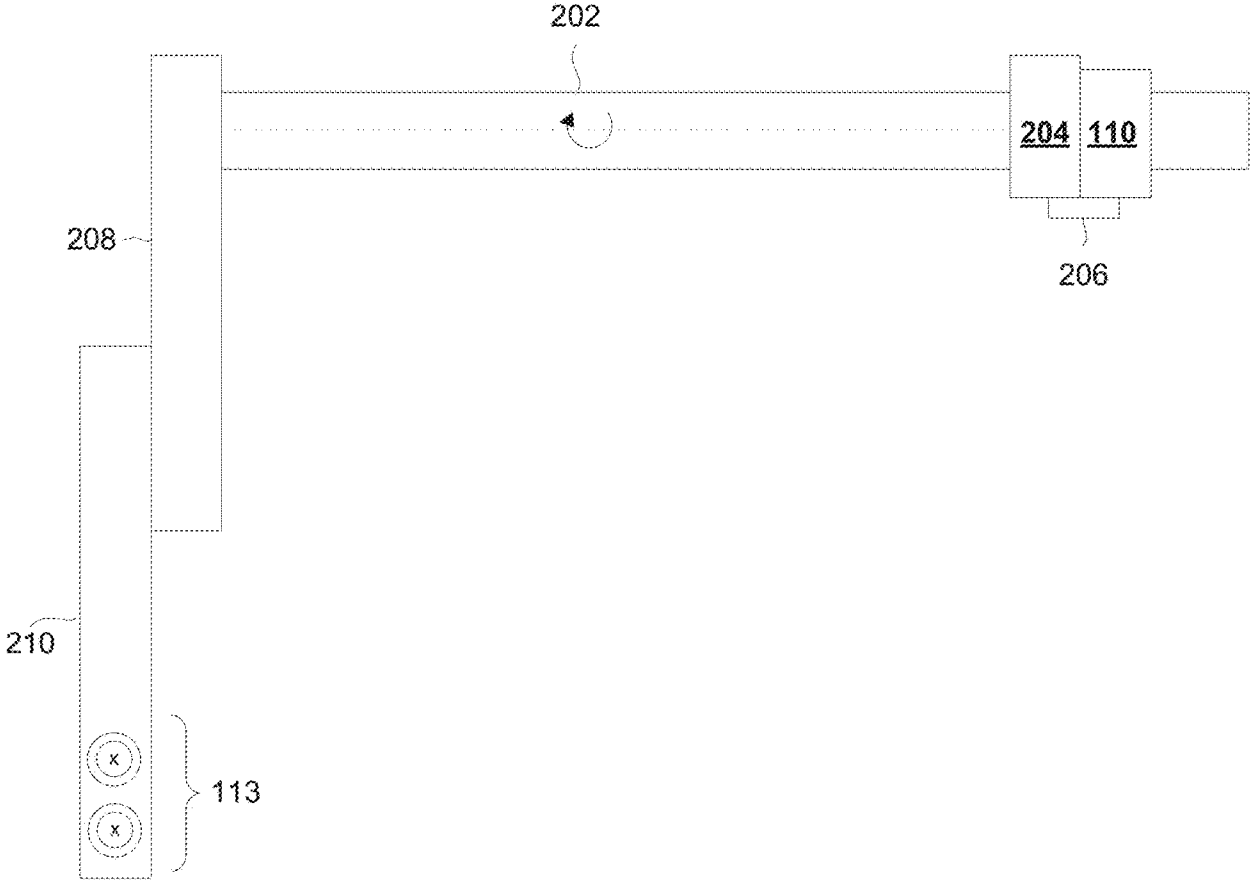
FIG. 4I is a front elevational view of the film breaking apparatus, according to some embodiments.

FIG. 4I shows a front view of the film breaking apparatus after passing by the striking member 116, according to some embodiments. As shown in FIG. 4I, the puncturing arm 112 rotates to return to a neutral position (e.g., through the use of a second biasing mechanism or the force of gravity). The puncturing members 113 are illustrated with circles with crosses to indicate that the puncturing members 113 rotate in a direction that is "going into" of the plane of FIG. 4I. The direction of movement of the puncturing members 113 is provided merely as an example, and is not meant to be limiting. For example, the puncturing members 113 may be moved in any direction that causes the puncturing members 113 to strike and therefore puncture the film.

Figure 5:
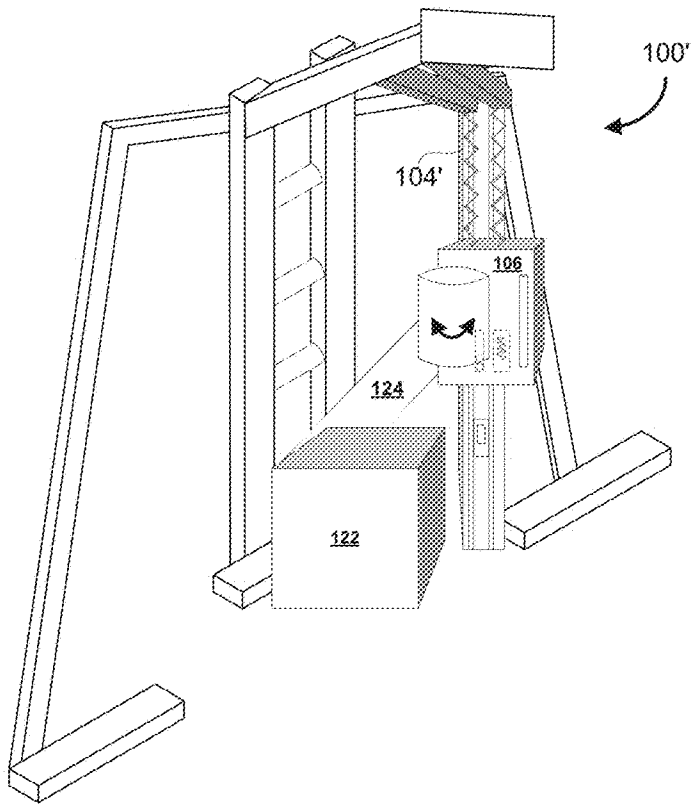
FIG. 5 is a perspective view of a wrapping machine having a rotary arm configuration, according to some embodiments.

As described above, dispenser carriage 106 is mounted to a stationary tower 104 and film is applied to a package 122 by rotation of the package. In other embodiments, for example, as depicted in FIG. 5, the dispenser carriage 106 is provided for use in a rotary arm wrapping machine 100'. The rotary arm wrapping machine 100', rather than utilizing a turntable to rotate the package 122 relative to a tower 104, has a tower 104' configured for rotation about a stationary package 122 when dispensing film. The same or similar principles from the turntable wrapping machine 100 example of FIG. 1 apply mutadis mutanis to the rotary arm wrapping machine 100. For example, tower 104' has a striker plate 114 and striker member 116 and a carriage 106 with a film breaking apparatus substantially identical to those of turntable wrapping machine 100. Film is dispensed in a helical pattern onto a package 122 by rotating carriage around the package while carriage 106 travels upwardly or downwardly along tower 104'. At the conclusion of wrapping, the film breaking apparatus is activated substantially as described above to cause puncturing members to contact and puncture the film.

As described above, puncturing arm 112 of the film breaking apparatus is rotated when trigger arm 110 contacts striker member 116 while moving upwardly. Flange 206, which is fixed to puncturing arm 112 is positioned beneath trigger arm 110 so that downward movement of the trigger arm causes it to bear against flange 206, rotating puncturing arm 112. Conversely, trigger arm 110 can move upwardly, as may occur when trigger arm 110 contacts striker member 116 during downward movement of carriage 106, without causing rotation of puncturing arm 112. In other embodiments, the film breaking apparatus may be configured to puncture film during downward carriage movement, rather than upward carriage movement. For example, flange 206 may be positioned above, rather than below trigger arm 110 such that upward movement of trigger arm 110 causes it to bear against flange 206, and trigger arm 110 is free to move downwardly without rotating puncturing arm 112.

As described above, carriage 106 moves upwardly and downwardly along tower 104', to dispense wrapping film on a package generally in a vertically-extending helical pattern. However, as will be apparent, in other embodiments, tower 104' and carriage 106 may be oriented differently, For example, a package could be mounted horizontally on a spindle, and tower 104' could likewise extend horizontally. In such a configuration, carriage 106 may move back and forth along a horizontal axis to wrap the package generally in a horizontally-extending helical pattern. The film breaking apparatus, striker plate and striker member may be configured so that contact between the trigger arm and striker member while the carriage moves in one direction causes rotation of the puncturing arm to puncture film, and contact between the trigger arm and the striker member while the carriage moves in the other direction may not cause rotation of the puncturing arm.

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps As can be understood, the examples described above and illustrated are intended to be exemplary only.

What is claimed is:

1. A film-breaking apparatus for a wrapping machine having a dispenser carriage movable along a wrapping axis for wrapping a film around a package, the film-breaking apparatus comprising:

a. a trigger arm coupled to said dispenser carriage;

b. a puncturing arm including a puncturing member, said puncturing arm pivotably connected to said trigger arm such that said trigger arm is free to rotate relative to said puncturing arm in a first rotational direction, and rotationally coupled to said puncturing arm in a second rotational direction;

c. said trigger arm configured to contact a striking member of said wrapping machine and rotate in said first rotational direction during motion of said dispenser carriage in a first direction along said wrapping axis, and to contact said striking member of said wrapping machine to cause rotation of said puncturing arm in said second rotational direction during motion of said dispenser carriage in a second direction along said wrapping axis, thereby puncturing said film being dispensed by said dispenser carriage with said puncturing member.

2. The film-breaking apparatus of claim 1, wherein said wrapping machine includes one or more guide members configured to guide movement of said dispenser carriage along said wrapping axis.

3. The film-breaking apparatus of claim 1, wherein said film is a sheet of film that is stretched for wrapping around said package.

4. The film-breaking apparatus of claim 1, wherein said striking member is a flange.

5. The film-breaking apparatus of claim 1, wherein said film-breaking apparatus operates mechanically, free of electrical components.

6. The film-breaking apparatus of claim 1, wherein said movement of said dispenser carriage combined with said rotation of either said package or said wrapping machine causes said package to be wrapped in a helical manner.

7. The film-breaking apparatus of claim 1, wherein said film is a polyethylene stretch film.

8. The film-breaking apparatus of claim 1, further comprising a biasing spring for biasing said puncturing arm such that said puncturing arm returns to an inactive position after rotation of said puncturing arm in said second rotational direction.

9. The film-breaking apparatus of claim 1, wherein said wrapping machine further comprises a turntable to rotate said package.

10. The film-breaking apparatus of claim 1, wherein said wrapping machine is configured to rotate said dispenser carriage in relation to said package.

11. A method of wrapping a film around a package, the method comprising:

a. attaching a film dispensed from a dispenser carriage to said package;

b. wrapping said film around said package, thereby drawing said film from said dispenser carriage;

c. moving said dispenser carriage along a wrapping axis, such that one or more layers of film are disposed onto said package generally in a spiral pattern, said one or more layers of film together binding said package;

d. passing said dispenser carriage past said striking member a first time without rotating said puncturing arm;

e. engaging a striking member of said wrapping machine by movement of said dispenser carriage along said wrapping axis, thereby triggering rotation of a puncturing arm of said dispenser carriage to puncture said film;

f. breaking said punctured film by application of tension; and wherein passing said dispenser carriage past said striking member a first time comprises rotating a trigger arm in a first direction and the engaging of said striking member comprises rotating said trigger arm in a second direction.

12. The method of claim 11, wherein wrapping said film around said package includes at least rotating said package such that rotation of said package draws said film from said dispenser carriage.

13. The method of claim 11, wherein said dispenser carriage is mounted to an arm;

a. wrapping said film around said package includes at least rotating said arm such that rotation of said arm draws said film from said dispenser carriage.

14. The method of claim 11, further comprising returning puncturing arm to an inactive position with a biasing spring.

15. The method of claim 11, wherein said engaging of said striking member comprises rotating a trigger arm.

16. The method of claim 11, further comprising preloading said film in said dispensing carriage.

17. The method of claim 16, wherein engaging said striking member to puncture said film includes puncturing said preloaded film.

18. A wrapping machine having a dispenser carriage movable along a wrapping axis for wrapping a film around a package, said dispenser carriage having a film-breaking apparatus, said film-breaking apparatus comprising:

a. a trigger arm coupled to said dispenser carriage;

b. a puncturing arm including a puncturing member, said puncturing arm pivotably connected to said trigger arm such that said trigger arm is free to rotate relative to said puncturing arm in a first rotational direction, and rotationally coupled to said puncturing arm in a second rotational direction;

c. said trigger arm configured to contact a striking member of said wrapping machine and rotate in said first rotational direction during motion of said carriage in a first direction along said wrapping axis, and to contact said striking member of said wrapping machine to cause rotation of said puncturing arm in said second rotational direction during motion of said carriage in a second direction along said wrapping axis, thereby puncturing said film being dispensed by said dispenser carriage with said puncturing member.

* * * * *